US005450884A

United States Patent [19]

Shih et al.

[11] Patent Number: 5,450,884

[45] Date of Patent: Sep. 19, 1995

[54] MULTI-COMPARTMENT SPOUT FOR FUEL DISPENSING NOZZLE

[75] Inventors: Chih-Kun J. Shih, Cary; David J. Parrish, Wake Forest, both of N.C.

[73] Assignee: Emco Wheaton, Inc., Morrisville, N.C.

[21] Appl. No.: 215,925

[22] Filed: Mar. 22, 1994

Related U.S. Application Data

[63] Continuation-in-part of Ser. No. 963,581, Oct. 19, 1992, Pat. No. 5,327,949.

[51] Int. Cl.[6] ..... B65B 57/06; B65B 57/14

[52] U.S. Cl. ..... 141/206; 141/208; 141/218; 141/392; 138/115

[58] Field of Search ..... 141/198, 206, 207, 208, 141/209, 218, 290, 301, 302, 305, 389, 392; 137/801; 251/368; 138/115

[56] References Cited

U.S. PATENT DOCUMENTS

| | | | |
|---|---|---|---|
| Re. 30,050 | 7/1979 | Hansel | 141/208 |
| 2,840,122 | 6/1958 | Klikunas et al. | 141/207 |
| 2,874,735 | 2/1959 | Boone | 141/208 |
| 3,012,592 | 12/1961 | Wright et al. | 141/208 |
| 3,088,500 | 5/1963 | Payne | 141/208 |
| 3,259,154 | 7/1966 | Scherer | 141/209 |
| 3,603,359 | 9/1971 | Belue | 141/208 |
| 3,638,689 | 2/1972 | Eklund | 141/214 |
| 3,719,215 | 3/1973 | Murray | 141/218 |
| 3,805,828 | 4/1974 | Panagrossi | 251/368 |
| 3,900,056 | 8/1975 | Giardini et al. | 141/290 |
| 4,005,339 | 1/1977 | Plantard | 141/392 |
| 4,199,012 | 4/1980 | Lasater | 141/52 |
| 4,223,706 | 9/1980 | McGahey | 141/59 |
| 4,232,715 | 11/1980 | Pyle | 141/1 |
| 4,351,375 | 9/1982 | Polson | 141/98 |
| 4,735,243 | 4/1988 | Ehlers | 141/218 |
| 4,796,678 | 1/1989 | Motohashi et al. | 141/208 |
| 5,174,346 | 12/1992 | Healy | 141/226 |
| 5,224,525 | 7/1993 | Weichel | 141/208 |
| 5,299,607 | 4/1994 | Monticup, Jr. | 141/208 |
| 5,327,945 | 7/1994 | Simpson et al. | 138/215 |
| 5,327,949 | 7/1994 | Dotson et al. | 141/206 |

*Primary Examiner*—Henry J. Recla
*Assistant Examiner*—Steven O. Douglas
*Attorney, Agent, or Firm*—Bell, Seltzer, Park & Gibson

[57] ABSTRACT

A multi-compartment spout for a fuel dispensing nozzle includes a cylindrical, longitudinally extending outer wall, and at least one interior, longitudinally extending dividing wall. The dividing wall defines a fuel passageway within the spout which communicates with a fuel passageway in the body of the nozzle for dispensing fuel into the fuel tank of a vehicle, and a vapor recovery passageway within the spout which communicates with a vapor recovery passageway in the body of the nozzle for returning fuel vapor to an underground tank and thereby preventing the vapor from escaping into the atmosphere. In a preferred embodiment, the spout includes another interior longitudinally extending dividing wall which defines a shut-off passageway within the spout which communicates with a venturi-vacuum chamber in the nozzle for automatically shutting off the flow of fuel through the nozzle when the vehicle fuel tank is full. The shut-off passageway within the spout has a common interior, longitudinally extending dividing wall with the fuel passageway or the vapor recovery passageway. The spout is extruded of a lightweight metal and the body of the nozzle is molded of a composite resin.

12 Claims, 2 Drawing Sheets

MULTI-COMPARTMENT SPOUT FOR FUEL DISPENSING NOZZLE

CROSS-REFERENCES TO RELATED APPLICATIONS

This application is a continuation-in-part of application Ser. No. 07/963,581 filed on Oct. 19, 1992, now U.S. Pat. No. 5,327,949, and is related to co-pending design application Ser. No. 29/001,149 filed Oct. 19, 1992.

FIELD OF THE INVENTION

The invention relates to a spout for a fuel dispensing nozzle. More specifically, the invention relates to a multi-compartment spout for dispensing fuel from a fuel dispensing nozzle of the vapor recovery or automatic shut-off type into the fuel tank of a vehicle.

Background of the Invention

Environmental concerns and regulations in some localities require that fuel dispensing nozzles include the ability to recover fuel vapor which escapes from a fuel tank during fueling of a vehicle. The fuel vapor must be captured and returned to an underground fuel tank, and not be permitted to escape into the atmosphere. Similarly, safety and economy concerns dictate that the flow of fuel from a fuel dispensing nozzle be automatically shut-off when the tank is full to prevent the excess fuel from spilling onto the ground and contaminating the soil and the air.

Fuel dispensing nozzles having vapor recovery capability take one of two known forms. U.S. Pat. RE No. 30,050 to Hansel and U.S. Pat. No. 5,174,346 to Healy describe vapor recovery nozzles which include a flexible accordion-shaped boot mounted to the egress end of the nozzle. The boot surrounds the spout and extends outwardly from the nozzle in the egress direction thereby defining a vapor recovery passageway in the space external of the spout and internal of the boot. The free end of the boot forms a seal against the opening of the fill pipe from the fuel tank. Pressure created by fuel rising in the tank displaces and forces fuel vapor to pass through the vapor recovery passageway in the spout and into a vapor recovery passageway in the nozzle. The fuel vapor is further driven from the vapor recovery passageway in the nozzle to a vapor recovery conduit within the fuel hose which is connected to the underground fuel tank. Vapor recovery nozzles of the flexible boot type are not particularly efficient and a substantial amount of vapor is allowed to escape into the atmosphere.

The second known form of vapor recovery nozzle is described, for example, in U.S. Pat. No. 4,199,012 to Lasater. The vapor recovery nozzle includes a vacuum pump for positively removing fuel vapor from a vehicle tank through an annular opening between concentric tubes in the spout. The spout is formed of inner and outer concentric tubes such that a vapor recovery passageway is provided in the space between the concentric tubes. Fuel is dispensed from the nozzle through the inner concentric tube into the fuel tank. The outer tube is sealed to the inner tube at the fuel dispensing end, and radially extending holes are provided in the outer tube to permit fuel vapor within the tank to be removed through the vapor recovery passageway by the vacuum pump. As is apparent, the spout utilized with this type of vapor recovery nozzle is difficult and expensive to fabricate. In addition to the fabrication difficulties posed by constructing a spout with concentric tubes, vapor recovery nozzles of the concentric tube type generally have the vacuum assist operating on all nozzles attached to a particular pump even if only one nozzle is in use. Thus, the operation of each pump requires a larger vacuum assist pump and wastes power.

Fuel dispensing nozzles of both known types typically include automatic shut-off mechanisms which interrupt the flow of fuel into a vehicle fuel tank when the tank is full. A fuel dispensing nozzle having an automatic shut-off mechanism is described in U.S. Pat. No. 2,874,735 to Boone. The flow of fuel through the nozzle passes a venturi-vacuum chamber device which creates a partial vacuum within a passageway extending from the egress end of the nozzle to the discharge end of the spout. The shut-off passageway is exposed to the air or vapor in the fuel tank through a radially extending opening in the wall of the spout near its discharge end. As fuel is dispensed into the tank, the partial vacuum created by the venturi-vacuum chamber draws vapor out of the tank. When the end of the shut-off passageway is blocked by fuel rising within the tank, the flow of vapor ceases and the vacuum evacuates the vacuum chamber within the nozzle which in turn disables the trigger mechanism and closes the main poppet valve. The shut-off passageway, like the vapor recovery passageway within the spout, is a separately formed hollow tube mounted inside the spout adjacent the outer wall of the fuel dispensing passageway. Thus, spouts utilized by nozzles having an automatic shut-off mechanism, like spouts for vapor recovery nozzles of the concentric tube type, are difficult and expensive to fabricate.

With the foregoing in mind, it is an object of the present invention to provide a spout for a fuel dispensing nozzle which overcomes the disadvantages and deficiencies of prior spouts.

A further object of the present invention is to provide a spout for a fuel dispensing nozzle of the vapor recovery or automatic shut-off type which is simpler, more efficient, and less expensive to fabricate.

SUMMARY OF THE INVENTION

The foregoing objects of the invention are accomplished by providing a spout for a fuel dispensing nozzle of the vapor recovery or automatic shut-off type in which the fuel dispensing passageway, the vapor recovery passageway, and the automatic shut-off passageway are integrally formed within the spout.

A fuel dispensing nozzle having vapor recovery capability and an automatic shut-off mechanism is described in related application Ser. No. 07/963,581. The nozzle includes a main body portion having a continuous fuel passageway which extends from its ingress end to its egress end. The main body portion also includes a vapor recovery passageway which extends from its egress end to its ingress end. The ingress end of the main body portion is adapted to be attached to a hose from a fuel pump having fuel delivery and vapor return conduits.

A housing encloses the main body portion and includes a handle portion extending outwardly from and in spaced relation to the main body portion. The handle portion includes a hand-grip portion adapted to be grasped by the hand of a user, which is in spaced relation to the main body portion such that the hand of the user does not come in contact with the main body portion of the nozzle. A spout is connected to the main body portion at its egress end. Fuel dispensing, vapor recovery and shut-off passageways which are open at their ends are integrally formed within the spout.

The vapor recovery passageway within the spout communicates with fuel vapor in the tank through an open end at the discharge end of the spout, and also laterally through radially extending holes provided in the outer wall of the spout. The handle portion of the housing has a vapor recovery passageway provided therethrough which communicates with the vapor recovery passageway within the spout and with a vapor return conduit within the fuel delivery hose.

An attitude responsive valve is provided in the vapor recovery passageway within the handle portion of the nozzle. When the nozzle is in any orientation other than that typical of having the spout within the fill opening of the vehicle fuel tank, the vapor recovery passageway through the handle portion of the nozzle housing is closed by the attitude responsive valve. In this manner, the vacuum assist cannot draw air or fuel vapor through the nozzle except when the nozzle is in a proper position for dispensing fuel into the vehicle fuel tank.

The housing of the nozzle also includes a shut-off passage and a venturi-vacuum chamber which is connected through a conduit to the fuel passageway in the main body portion and to the shut-off passageway within the spout. A trigger mechanism is mounted for pivotable movement on the main body portion and is connected through a linkage mechanism to a valve stem attached to a main poppet valve in the fuel passageway. An operating portion of the trigger mechanism extends outwardly from the main body portion toward the handle portion in position to be engaged and manipulated by a user grasping the handle portion of the nozzle.

The trigger linkage mechanism connecting the trigger to the main poppet valve includes a portion connected to a diaphragm on the venturi-vacuum chamber. When the shut-off passageway in the spout is blocked by fuel rising in the tank, the vacuum evacuates the chamber and the diaphragm disconnects the trigger mechanism from the main poppet valve thereby closing the main poppet valve and interrupting the flow of fuel from the nozzle.

In a preferred embodiment, the spout includes a cylindrical, longitudinally extending outer wall and at least one interior, longitudinally extending dividing wall integrally formed with the outer wall. The outer wall and the dividing wall thereby define a fuel passageway communicatively connected to the fuel passageway in the main body portion, and a vapor recovery passageway communicatively connected to the vapor recovery passageway in the main body portion. The spout includes another interior, longitudinally extending dividing wall integrally formed with the outer wall such that the outer wall and the other dividing wall define the fuel passageway within the spout and a shut-off passageway communicatively connected to the venturi-vacuum chamber in the main body portion of the nozzle.

In another preferred embodiment, the spout includes a cylindrical, longitudinally extending outer wall and two interior, longitudinally extending dividing walls integrally formed with the outer wall of the spout. The outer wall and the dividing walls thereby define a fuel passageway communicatively connected to the fuel passageway in the main body portion, and two vapor recovery passageways communicatively connected to the vapor recovery passageway in the main body portion. In this embodiment, the fuel passageway is preferably centrally located between the vapor recovery passageways within the spout.

In another preferred embodiment, the spout includes a cylindrical, longitudinally extending outer wall and at least one interior, longitudinally extending dividing wall integrally formed with the outer wall. The outer wall and the dividing wall thereby define a fuel passageway communicatively connected to the fuel passageway in the main body portion, and a vapor recovery passageway communicatively connected to the vapor recovery passageway in the main body portion. The spout includes another interior, longitudinally extending dividing wall integrally formed with the outer wall such that the outer wall and the other dividing wall define the vapor recovery passageway within the spout and a shut-off passageway communicatively connected to the venturi-vacuum chamber in the main body portion of the nozzle.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENTS

Figure 1:
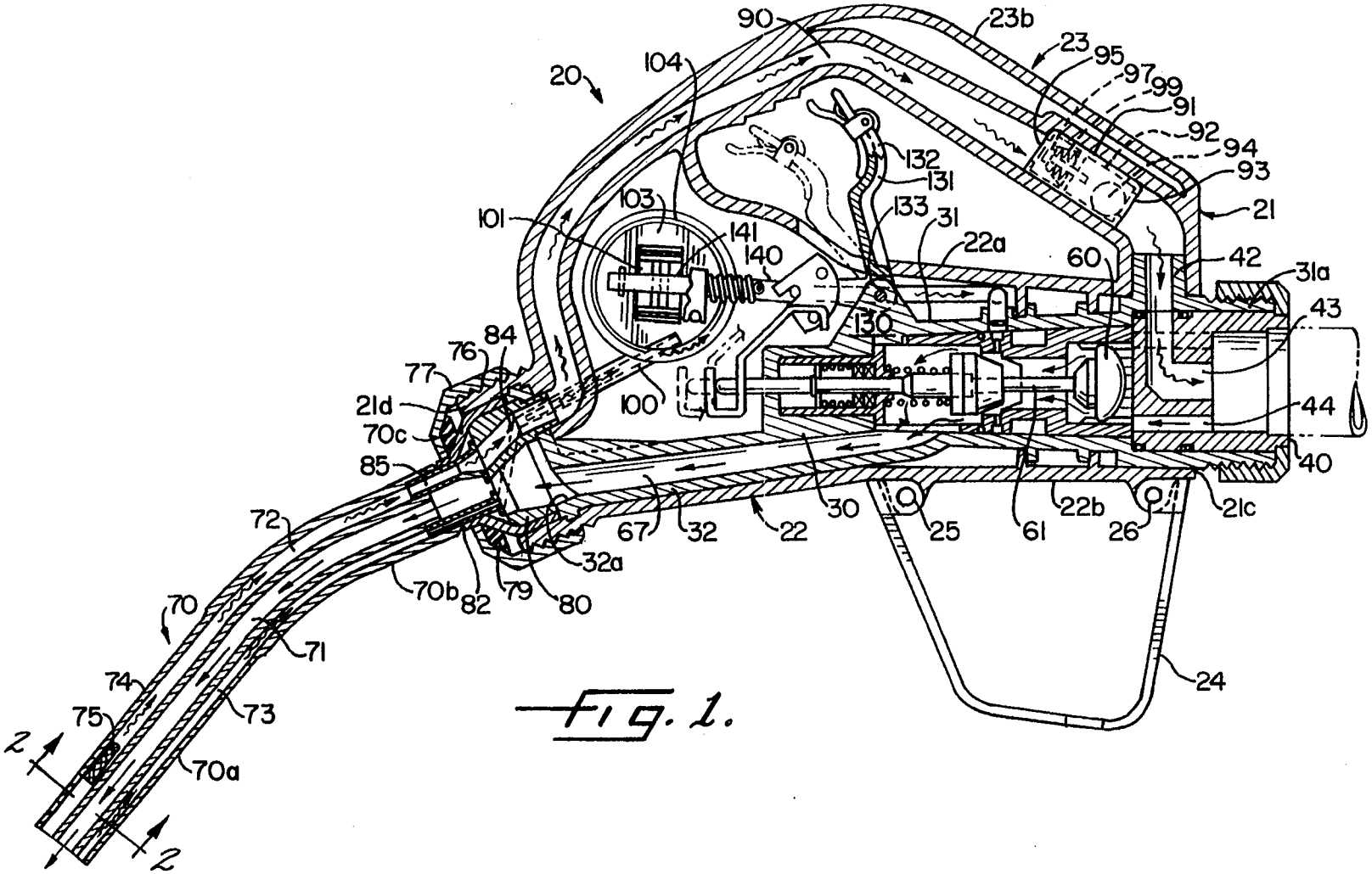
FIG. 1 is a longitudinal sectional view of a nozzle of the type described in related application Ser. No. 07/963,581 incorporating the spout of the present invention.

Referring now more particularly to the drawings wherein a preferred embodiment of the present invention is shown, a nozzle of the vapor recovery and automatic shut-off type incorporating the spout of the present invention is generally indicated at 20. A detailed description of fuel dispensing nozzle 20 is provided in application Ser. No. 07/963,581 entitled "Fuel Dispensing Nozzle" filed Oct. 19, 1992, which is herein incorporated by reference.

The nozzle 20 comprises a housing 21 which is preferably formed in two complementary halves separated along the longitudinal center line of the housing 21. Preferably, each of the two halves of housing 21 is formed integral and may be constructed of any suitable material, but preferably is molded of a composite resin comprising a nylon 6 base and long glass fiber reinforcement. The complementary halves may be secured together by any desired means, as for example by a suitable adhesive.

The housing 21 includes a main housing body 22 and a handle 23. Main housing body 22 is hollow and defines a chamber therein which is open at its opposite ends. The shape of main housing body 22 is dictated by the nozzle operating parts and assemblies confined therein or mounted thereon. It is noted, however, that such shape should be aesthetically pleasing as well as functional and should lend itself to molding with a minimum of operations, including assembly, being required thereafter.

Handle 23 is elongate and is formed integral with main housing body 22 at opposite ends thereof. The medial portion of handle 23 is spaced outwardly from the upper wall 22*a* of the main housing body 22 a sufficient distance to permit the hand of a user to comfortably fit around the handle 23 and within the space between handle 23 and the upper wall 22*a* of main housing body 22.

A hanger bracket 24 is mounted at its opposite ends on the bottom wall 22*b* of main housing body 22 by suitable rivets or pins 25, 26. Pins 25, 26 may be removed to permit the removal of hanger bracket 24 and the replacement thereof by a hanger bracket of different configuration as dictated by the particular nozzle support mechanism on the service station pump with which nozzle 20 is to be used.

The nozzle 20 further includes a nozzle body member 30 mounted and substantially enclosed in main housing body 22 of housing 21. Nozzle body member 30 has a main valve portion 31 and a fuel delivery portion 32. Main valve portion 31 has an ingress end 31*a* extending through the ingress end 21*c* of housing 21 which is adapted to be connected to a fuel delivery hose of a service station pump. Fuel delivery portion 32 of nozzle body member 30 is formed integral with main valve portion 31 and extends therefrom to the egress end 21*d* of housing 21. Fuel delivery portion 32 has an egress end 32*a* of larger diameter, corresponding to the internal diameter of egress end 21*d* of housing 21.

Nozzle body member 30 may be constructed of any suitable material that is resistant to the fuels with which nozzle 20 may be employed, but preferably is formed of a composite resin comprising a nylon 6 base with long glass fiber and carbon fiber reinforcement. Further, while nozzle body member 30 may be formed in any suitable manner, it is preferred that nozzle body member 30 be molded such that machining of the molded nozzle body member 30 is not required.

Main valve portion 31 of nozzle body member 30 is generally hollow with the interior thereof formed with cavity sections of various diameters, some of which are of constant diameter throughout and others of which are of varying or changing diameter. The ingress end 31*a* has the largest diameter cavity and receives therein a separator insert 40.

A hollow boss 42 is formed integrally with main valve portion 31 adjacent ingress end 31*a*. Separator insert 40 has an L-shaped passageway 43 therein, the vertical portion being aligned and communicating through boss 42 with a vapor recovery passageway 90 in handle 23. The horizontal portion of L-shaped passageway 43 being adapted to be communicatively connected to the vapor return conduit (not shown) in the fuel delivery hose of a service station pump.

A main poppet valve 60 having a valve stem 61 is mounted within nozzle body member 30. Fuel delivery portion 32 of nozzle body member 30 has a longitudinal fuel passageway 67 therethrough which communicates at its upstream end with the hollow interior of main valve portion 31. A fuel passageway is thereby formed which extends from egress end 32*a* of fuel delivery portion 32, to ingress end 31*a* of main valve portion 31 and into a passageway 44 through separator insert 40. Passageway 44, the hollow interior of main valve portion 31, and fuel passageway 67 thus combine to form a fuel passageway which extends through main valve portion 31 in a generally straight line devoid of any abrupt changes in direction or substantial impediments to the flow of fuel.

A spout 70 is mounted on the egress end 21*d* of housing 21 and extends outwardly and terminates in a free end portion 70*a*. Spout 70 has a fuel passageway 71, at least one vapor recovery passageway 72, and a shut-off passageway 73 formed within spout 70. Preferably, spout 70 is integrally formed and most preferably is extruded of a suitable lightweight metal, such as aluminum. The fuel passageway 71 is the largest of the three passageways through spout 70, while vapor recovery passageway 72 is of intermediate size and shut-off passageway 73 is smaller than vapor recovery passageway 72 and fuel passageway 71.

Vapor recovery passageway 72 is preferably quarter-circular in cross-section, but may have any shape which can be formed integrally within spout 70. Shut-off passageway 73 is preferably circular in crosssection, but may have any shape which can be formed integrally within spout 70. All three passageways end in open ends at the free end portion 70*a* of spout 70, but vapor recovery passageway 72 has additional communication with air or fuel vapor through spaced holes 74 in the side of spout 70. A strainer 75 is positioned in vapor recovery passageway 72 downstream of the holes 74 to prevent rust and sediment in the tank from being brought into the nozzle by the vacuum assist in the fuel pump.

Figure 2:
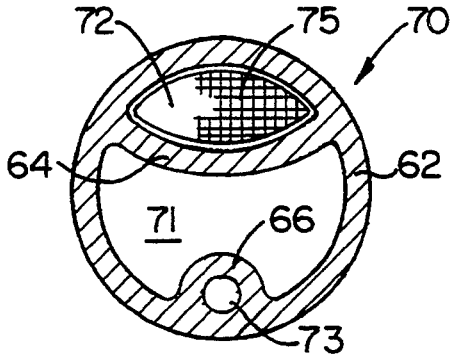
FIG. 2 is a transverse sectional view taken substantially along line 2—2 in FIG. 1 showing the cross-section of a preferred embodiment of the spout.

In the preferred embodiment illustrated in FIG. 2, spout 70 has a fuel passageway 71, a vapor recovery passageway 72, and a shut-off passageway 73 formed integrally within spout 70. Spout 70 has a cylindrical, longitudinally extending outer wall 62, and an interior, longitudinally extending dividing wall 64 formed integrally with outer wall 62 such that dividing wall 64 separates and defines fuel passageway 71 and vapor recovery passageway 72. Another interior, longitudinally extending dividing wall 66 is formed integrally with outer wall 62 to separate and define fuel passageway 71 and shut-off passageway 73. As shown in FIG. 1, the sides of the dividing walls 64, 66 are unitary with the outer wall 62 along there entire length and are coterminous with the outer wall at the free, or discharge, end portion 70*a* of spout 70.

Figure 3:
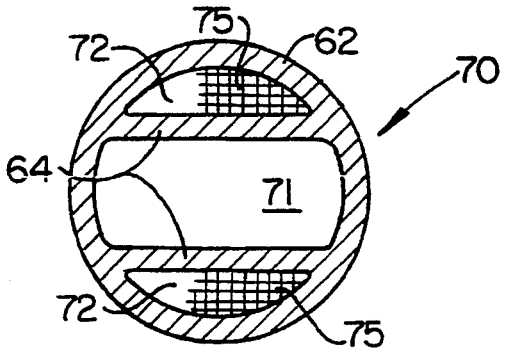
FIG. 3 is a transverse sectional view taken substantially along line 2—2 in FIG. 1 illustrating the cross-section of another preferred embodiment of the spout.

In the preferred embodiment illustrated in FIG. 3, spout 70 has a fuel passageway 71, and two vapor recovery passageways 72 formed integrally within spout 70. Spout 70 has a cylindrical, longitudinally extending outer wall 62, and two interior, longitudinally extending dividing walls 64 formed integrally with outer wall 62 such that dividing walls 64 separate and define fuel passageway 71 and vapor recovery passageways 72. As shown in FIG. 1, the sides of the dividing walls 64 are unitary with the outer wall 62 along their entire length and are coterminous with the outer wall at the free, or discharge, end portion 70*a* of spout 70. Fuel passageway 71 is preferably centrally located between symmetric vapor recovery passageways 72, but fuel passageway 71 may be located anywhere within spout 70, and vapor recovery passageways 72 need not be symmetric.

Figure 4:
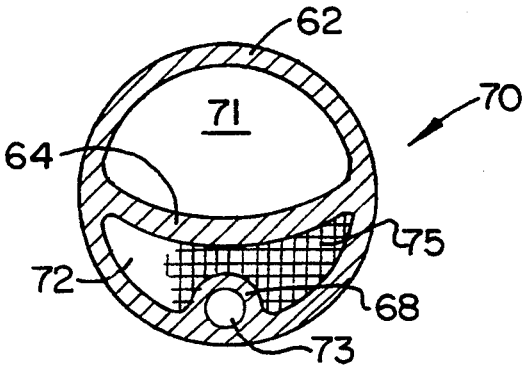
FIG. 4 is a transverse sectional view taken substantially along line 2—2 in FIG. 1 illustrating the cross-section of another preferred embodiment of the spout.

In the preferred embodiment illustrated in FIG. 4, spout 70 has a fuel passageway 71, a vapor recovery passageway 72, and a shut-off passageway 73 formed integrally within spout 70. Spout 70 has a cylindrical, longitudinally extending outer wall 62, and an interior, longitudinally extending dividing wall 64 formed integrally with outer wall 62 such that dividing wall 64 separates and defines fuel passageway 71 and vapor recovery passageway 72. Another interior, longitudinally extending dividing wall 68 is formed integrally with outer wall 62 to separate and define vapor recovery passageway 72 and shut-off passageway 73. As shown in FIG. 1, the sides of the dividing walls 64, 68 are unitary with the outer wall 62 along their entire length and are coterminous with the outer wall at the free, or discharge, end portion 70*a* of spout 70.

Spout 70 is initially formed straight, but is bent intermediate its ends into a curved configuration for easy insertion of the free end portion 70*a* into the fill pipe opening of a vehicle fuel tank. Also, while spout 70 may have a wall thickness uniform throughout, it is preferred that the outer wall thickness of spout 70 be initially formed thicker than the outer wall thickness for the free end portion 70*a* that will allow for insertion into the fuel tanks of different vehicles. To form the free end portion 70*a*, the excess material is machined away to provide a free end portion 70*a* of the close tolerances required. The thicker material in the spout portion 70*b* of spout 70 provides added strength and stability to the spout 70.

The end of spout 70 mounted on the egress end 21*d* of housing 21 has a bell portion 70*c* thereon. The smaller end of the bell portion 70*c* is of the same diameter both externally and internally as the diameter of the spout portion 70*b*, while the larger end of bell portion 70*c* is of the same external diameter as the diameter of egress end 32*a* of fuel delivery portion 32. Bell portion 70*c* may be formed integrally with the spout portion 70*b* or may be formed separately and attached to spout portion 70*b*.

Spout 70 is mounted on the egress end 21*d* of housing 21 by being received within the outer end thereof and abutting against the egress end 32*a* of fuel delivery portion 32. The egress end 21*d* of housing 21 is externally threaded and a spout nut 77 is threadably received on the threaded portion 76. Spout nut 77 has an opening through which the smaller end of bell portion 70*c* of spout 70 penetrates. An elastomeric gasket or spout gland 79 is positioned between spout nut 77 and the bell portion 70*c* of spout 70 to apply pressure to the bell portion 70*c* without deforming the same.

Mounted within the bell portion 70*c* of spout 70 is a spout connector assembly 80. The outer surface of spout connector assembly 80 is contoured to fit snugly within the bell portion 70*c*. Spout connector assembly 80 has an opening which communicates with fuel passageway 67 in fuel delivery portion 32 of nozzle body member 30 at one end, and with fuel passageway 71 in spout 70 at its other end. Spout connector assembly 80 has an opening 84 to permit fuel vapor to pass through the spout connector assembly 80. A connector conduit 85 connects opening 84 in spout connector assembly 80 to vapor passageway 72 in spout 70. Spout connector assembly 80 has an another opening which communicates through a connector conduit 82 to shut-off passageway 73 in spout 70 at one end, and with an opening in egress end 32*a* at its other end for reasons to be described hereinafter.

Spout connector assembly 80 has a portion of its inner end extending into vapor recovery passageway 90 in main housing body 22 and handle 23. The opposite end of vapor recovery passageway 90 in handle 23 is slightly enlarged and receives boss 42 on nozzle body member 30 such that the passageway through boss 42 is in communication with vapor recovery passageway 90 through handle 23. A continuous vapor recovery passageway is thereby provided through nozzle 20 which consists of vapor recovery passageway 72 in spout 70, connector conduit 85, opening 84 through spout connector assembly 80, vapor recovery passageway 90, the passageway through boss 42, and passageway 43 in separator insert 40.

An attitude responsive valve 91 is mounted in a casing 92 located in the enlarged end portion of vapor recovery passageway 90 in handle 23 above boss 42. When nozzle 20 is in a vertical attitude, such as when the nozzle is hanging from a service station pump, the casing 92 will be only slightly inclined from the vertical and ball 94 will roll onto the valve seat and close opening 93 in casing 92. Therefore, the vacuum being drawn on the vapor recovery passageway 90 by the vacuum assist within the service station pump will be prevented from passing the attitude responsive valve 91. When nozzle 20 is in a generally horizontal attitude, casing 92 will be almost horizontal and ball 94 will be displaced from opening 93. It should be noted that the vacuum assist from the fuel pump when ball 94 is displaced from opening 93 will be sufficient to overcome the biasing action of spring 99 and move valve member 97 away from its valve seat 95 to permit fuel vapor to pass through casing 92 and into the remainder of vapor recovery passageway 90 in handle 23.

Nozzle 20 includes an automatic shut-off mechanism for terminating the flow of fuel through the nozzle when the vehicle fuel tank is full. Housing half 21*a* has a conduit 100 formed therein which communicates at one end with the opening in egress end 32*a* and at its other end with a venturi-vacuum chamber means 101. A continuous shut-off passageway for activating the automatic shut-off mechanism is thereby formed by shut-off passageway 73 in spout 70, connector conduit 82, the opening in spout connector assembly 80, the opening in egress end 32*a* of nozzle body member 30, and conduit 100.

Venturi-vacuum chamber means 101 is formed by a cylindrical flange or wall formed integrally with one housing half and projecting outwardly from the inside of the side wall of the housing half toward the remaining housing half. The outer end of the cylindrical wall is closed by a diaphragm assembly 103 which, with the cylindrical wall and the enclosed portion of the side wall of housing body 22, defines a vacuum chamber 104.

Nozzle body member 30 has an upstanding boss 130 formed integrally therewith. Boss 130 serves as one part of a mounting means for a valve-actuating assembly 131 and more specifically for a trigger member 132 of the valve-actuating assembly 131. Trigger member 132 is generally L-shaped and is pivotally mounted on boss 130 by a pivot pin 133. Trigger member 132 is positioned such that a user grasping the handgrip portion 23*b* of handle 23 may readily engage and operate trigger member 132 with his or her forefinger, or forefinger and middle finger.

A trigger linkage assembly 140 is provided for connecting the trigger member 132 to the valve stem 61 of the main poppet valve 60. The trigger linkage assembly 140 comprises a square guide insert or mounting member 141, which is stationarily mounted on one housing half. The medial portion of square guide insert 141 projects toward and is connected to venturi-vacuum chamber means 101 as described in detail in application Ser. No. 07/963,581.

In operation, nozzle 20 is connected to the end of a fuel delivery hose of a service station pump. The pump is in turn is connected to an underground fuel tank. The fuel delivery hose and the service station pump are not part of this invention, but the fuel delivery hose should include both a fuel conduit and a vapor recovery conduit therein and the service station pump should include a vacuum assist connected to the vapor recovery conduit of the hose.

When not in use, nozzle 20 will be mounted on the service station pump by having the hanger 24 hooked over the nozzle hanger mechanism provided on the service station pump. Such service station pumps typically have a nozzle repository thereon which includes a cavity into which the spout 70 and the hanger 24 are received. In this position on the service station pump, nozzle 20 has the handle 23 extending outwardly in position to be readily grasped by the hand of a user.

In such a position, nozzle 20 will be in a vertical orientation and the attitude responsive valve 91 will be operable to close the vapor recovery passageway 90 through nozzle 20 to ensure that air will not pass through nozzle 20 into the underground tank when nozzle 20 is resting on the service station pump. The nozzle 20 removes vapor from the fuel tank by the vacuum assist of the pump pulling a vacuum on the continuous vapor recovery passageway defined in nozzle 20 by vapor recovery passageway 72 in spout 70, vapor recovery passageway 90 in housing 21 and handle 23, and the remainder of the passages for vapor recovery. Such vapor recovery continues until the fuel flow ceases.

During fueling, the flow of fuel past diaphragm assembly 103 will create a venturi action which in turn will create a partial vacuum in the continuous shut-off passageway defined in nozzle 20 by shut-off passageway 73 in spout 70, conduit 100 and the remainder of the passages for the shut-off mechanism. When shut-off passageway 73 is blocked by rising fuel in the tank, the flow of vapor ceases and the vacuum evacuates vacuum chamber 104 which then moves trigger linkage assembly 140 to cause trigger mechanism 132 to be disconnected from valve stem 61 thereby preventing additional fuel from being dispensed through nozzle 20.

In the drawings and specifications, there has been set forth a preferred embodiment of the invention, and although specific terms are employed, they are used in a generic and descriptive sense only and not for purposes of limitation.

That which is claimed is:

1. A fuel dispensing nozzle comprising:

(a) a main body portion having a fuel passageway extending from an ingress end of said main body portion to an egress end thereof and a vapor recovery passageway extending from said egress end of said main body portion to said ingress end thereof, the ingress end of said main body portion being adapted to be attached to a hose having fuel delivery and vapor return conduits therein, said main body portion further comprising venturi-vacuum chamber means adjacent the egress end of said main body portion;

(b) valve means mounted in said fuel passageway in said main body portion for controlling the flow of fuel through said nozzle;

(c) valve actuating means operatively coupled to said valve means for opening and closing said valve means; and (d) a spout mounted to the egress end of said main body portion and extending outwardly therefrom, said spout comprising a discharge end, a cylindrical outer wall, and a plurality of interior, longitudinally extending dividing walls integrally formed with said outer wall such that the sides of the dividing walls are unitary with said outer wall along the length of the dividing walls and coterminous with said outer wall at said discharge end of said spout, the dividing walls and said outer wall defining a fuel passageway communicatively connected to said fuel passageway in said main body portion, a vapor recovery passageway communicatively connected to said vapor recovery passageway in said main body portion, and a shut-off passageway communicately connected to said venturi-vacuum chamber means of said main body portion.

2. A fuel dispensing nozzle according to claim 1 wherein said shut-off passageway in said spout and said fuel passageway in said spout have a common interior, longitudinally extending dividing wall integrally formed with said outer wall such that the sides of the dividing wall are unitary with said outer wall along the length of the dividing wall and coterminous with said outer wall at said discharge end of said spout.

3. A fuel dispensing nozzle according to claim 1 wherein said shut-off passageway in said spout and said vapor recovery passageway in said spout have a common interior, longitudinally extending dividing wall integrally formed with said outer wall such that the sides of the dividing wall are unitary with said outer wall along the length of the dividing wall and coterminous with said outer wall at said discharge end of said spout.

4. A fuel dispensing nozzle according to claim 1 wherein said spout is extruded of lightweight metal.

5. A fuel dispensing nozzle according to claim 4 wherein said lightweight metal is aluminum.

6. A fuel dispensing nozzle according to claim 1 wherein said main body portion is molded of a composite resin.

7. A fuel dispensing nozzle according to claim 6 wherein said resin is a thermoplastic material having reinforcing fibers therein.

8. A fuel dispensing nozzle according to claim 7 wherein said thermoplastic material is nylon and said reinforcing fibers include long glass fibers.

9. A fuel dispensing nozzle according to claim 1 further comprising attitude responsive means in said vapor recovery passageway in said main body portion for closing said passageway when said nozzle is not in position for dispensing fuel into a vehicle fuel tank.

10. A fuel dispensing nozzle characterized by vapor recovery capability, said nozzle comprising:

(a) a housing having an elongate hollow main body portion open at both ends thereof and comprising venturi-vacuum chamber means adjacent one of the open ends, and a handle portion spaced from said main body portion, said handle portion being adapted to be grasped by the hand of a user of said nozzle without contact with said main body portion, said housing having a vapor recovery passageway therein communicating with the opposite open ends of said main body portion, (b) an elongate nozzle body member mounted in said hollow main body portion of said housing and including ingress and egress ends thereof disposed in said opposite ends of said main body portion of said housing, said nozzle body member having a fuel passageway extending longitudinally therethrough from said ingress end thereof to said egress end thereof, said ingress end of said nozzle body member being adapted to be connected to a fuel delivery hose on a service station fuel pump having both fuel delivery and vapor recovery conduits therein, (c) main valve means mounted in said nozzle body member in said fuel passageway for movement between open and closed positions for controlling the flow of fuel through said nozzle, (d) main valve actuating means mounted in said main body portion of said housing and connected to said main valve means for moving said valve means between its open and closed positions, said main valve actuating means including trigger means disposed between said main body portion and said handle portion of said housing for manual operation of said main valve actuating means by a user of said nozzle, and (e) a spout mounted on said main body portion of said housing at the egress end of said nozzle body member and extending outwardly therefrom, said spout having a discharge end adapted to be inserted into the fill opening of a vehicle fuel tank, said spout having a cylindrical outer wall and a plurality of interior, longitudinally extending dividing walls integrally formed with said outer wall such that the sides of the dividing walls are unitary with said outer wall along the length of the dividing walls and coterminous with said outer wall at said discharge end of said spout, the dividing walls and said outer wall defining a fuel passageway therethrough which is communicatively connected to said fuel passageway in said nozzle body member for receipt of fuel therefrom when said main valve means is in open position and for dispensing fuel into the vehicle fuel tank, a vapor recovery passageway therethrough communicatively connected to said vapor recovery passageway in said housing for removing vapor from the vehicle fuel tank and delivering such vapor to the vapor recovery conduit in the fuel delivery hose, and a shut-off passageway communicately connected to said venturi-vacuum chamber means of said main body portion.

11. A fuel delivery nozzle according to claim 10 wherein said housing and said nozzle body member are molded of composite resin and said spout is extruded of lightweight metal.

12. A fuel delivery nozzle according to claim 10 wherein said main valve actuating means includes linkage means connecting said trigger means to said main valve means.

* * * * *